United States Patent [19]

Sagaser et al.

[11] Patent Number: 4,495,770

[45] Date of Patent: Jan. 29, 1985

[54] HYDROSTATIC CONTROL SYSTEM

[75] Inventors: Thomas M. Sagaser; Patrick Kuhn; Knute K. Brock, all of Bismarck, N. Dak.

[73] Assignee: Clark Equipment Company, Buchanan, Mich.

[21] Appl. No.: 541,828

[22] Filed: Dec. 21, 1983

Related U.S. Application Data

[63] Continuation of Ser. No. 251,440, Apr. 6, 1981, abandoned.

[51] Int. Cl.[3] ..... F16H 39/48

[52] U.S. Cl. ..... 60/486; 60/428; 60/445

[58] Field of Search ..... 60/428, 429, 430, 465, 60/486, 375, 387, 423, 445, 382, 427; 92/DIG. 4; 417/216

[56] References Cited

U.S. PATENT DOCUMENTS 3,916,625 11/1975 Holtkamp ..... 60/427

*Primary Examiner*—Robert E. Garrett
*Assistant Examiner*—John M. Husar
*Attorney, Agent, or Firm*—Kenneth C. Witt

[57] ABSTRACT

The hydrostatic control system for an articulate loader provides an improved method for controlling the output of a hydrostatic drive unit for a front end loader, with cooperative connecting means disposed between a pair of axially aligned drive pumps to provide selective output of one or both pumps as dictated by operation of the control mechanism.

21 Claims, 1 Drawing Figure

HYDROSTATIC CONTROL SYSTEM

This application is a continuation, of application Ser. No. 251,440, filed Apr. 6, 1981 now abandoned.

CROSS REFERENCES

U.S. patent applications filed simultaneously herewith, one in the name of Thomas M. Sagaser entitled "Pump Centering Control," Ser. No. 251,439, filed Apr. 6, 1981, and the other in the name of Charles W. Frost entitled "An Improved Arrangement for the Brake System of a Hydrostatic Loader Including a Valve Port Block", Ser. No. 251,438, now U.S. Pat. No. 4,417,649 filed Apr. 6, 1981, both assigned to the Assignee of the present invention.

BACKGROUND OF THE INVENTION

1. Field of the Invention

In a hydrostatic drive system, it is desirable to have precise control of the engine output in both the forward and reverse directions. However, it is also desirable that the pedal controlling the output of the hydrostatic drive pumps be limited to a relatively small amount of travel. Preferably, it would be advantageous to reduce the amount of pedal travel at higher speeds while providing a greater amount of pedal travel at lower speeds so that the operator could have more precise control over the output of the hydrostatic system particularly at low speeds. It is an object of the present invention to provide a simple control mechanism associated with the output of the hydrostatic drive motor to achieve precise pedal control for the operator.

2. History of the Prior Art

Most conventional drive systems for hydrostatic front end loaders use a single hydrostatic pump and a single hydrostatic motor. This does not allow them to split the system and use half the oil for the low speed range and all of the oil for the higher speed range. Further, in a conventional system typically such operations as filling the loader bucket or digging use all of the oil available from the pump and it is very difficult to control the amount of engine horsepower used. A conventional system is constantly putting a drain on torque at high speeds and therefore operates very inefficiently. Also in a conventional system, pedal travel is directly proportional to output.

Further, in a conventional system, at higher speeds the deceleration is so fast that only by orificing the pump down to reduce pedal travel could a relatively slow rate of deceleration be produced. However, if the pump orifice is reduced, when you are accelerating you are accelerating very slowly and when you are decelerating you are decelerating very slowly. Consequently, the cycle time for the machine is considerably increased and should a front end loader be driven into a pile of dirt too hard at high speeds, the engine has a tendency to stall because the deceleration of the hydrostatic drive system is so slow that you cannot back off the hydrostatic drive pumps fast enough.

SUMMARY OF THE INVENTION

The present invention employs a pair of axially aligned hydrostatic drive pumps plumbed together with a single hydrostatic output motor. A precise control mechanism coupling the infinitely variable swash plates of the hydrostatic output pumps with the operator speed control pedal provides a precise control over pump output such that only half of the pump output oil is used for the low speed range and all of the pump output flow is used for the higher speed range. Essentially the control mechanism enables the operator to use only one pump for the low speed range and provides the operator with twice the pedal stroke for the same volume of oil. Before the second pump is stroked, the operator is utilizing the precise amount of horsepower required, enabling him to have very good control over digging and dumping. The second pump is utilized only when the operator depresses the foot pedal further to achieve higher speeds. The amount of pedal travel at these higher speeds is less than the amount of pedal travel at lower speeds.

In the present system the control mechanism between the output pumps provides that when the vehicle travels in reverse only a single pump is stroked so that there is limited travel speed in reverse. However, the control system could be easily modified to provide a two speed operation off a single pedal in both the forward and reverse directions.

A further advantage of the present system is that the control mechanism inherently provides an automatic two speed operation controlled simply by the amount of pedal travel exerted by the operator. The operator can switch from a low speed operation to high speed operation by increasing the amount of pedal travel. There is no shifting or flipping of levers or other external operations associated with the two speed output of the drive motor.

Finally, the mechanism provides that when the operator takes his foot off the pedal at high speeds the hydrostatic output motor does not decelerate quickly. The second pump has a substantial dampening effect on deceleration of the vehicle to provide smooth stops. Control between the front and rear pumps enabling the rear pump to "float" provides a cushion that cannot be obtained with a single pump arrangement. Deceleration can be very gradual at high speeds and relatively swift at lower speeds. The control mechanism between the hydrostatic output pumps not only provides a dampening effect for smooth deceleration but also limits the acceleration rate which gives the operator very smooth control of his vehicle.

Accordingly, the present invention provides an improved method for controlling the output of a hydrostatic drive unit for a vehicle or front end loader, the drive unit comprising a pair of output pumps axially aligned, a drive motor, cooperative means between the drive motor and the output pumps to couple the output pumps to the drive motor, operative means to control the output of the drive motor, the improvement comprising cooperative connecting means between the aligned drive pumps to operatively couple the drive pumps, such connecting means including selective operative means to selectively control the output of one or both pumps.

The control and operation of the present invention and the advantages inherent therein will become more apparent through an examination of the accompanying drawing and through the more detailed description set forth below.

DETAILED DESCRIPTION OF THE PRESENT INVENTION

Figure 1:
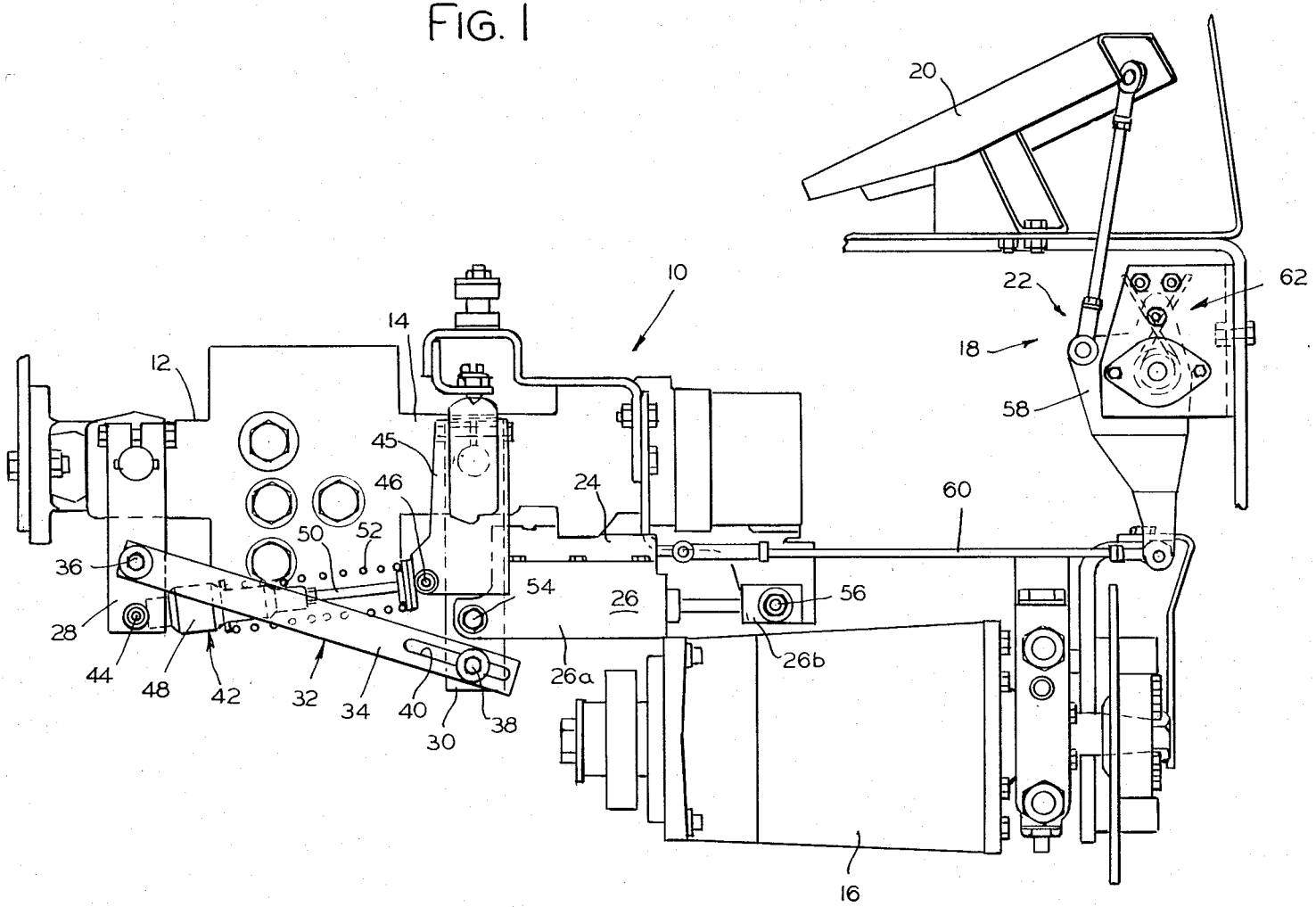
FIG. 1 is a side elevational view of the drive system of an articulate loader wherein the control mechanism of the present invention is clearly shown.

Drive system 10 of a hydrostatic front end loader (not shown) includes hydrostatic drive pumps 12 and 14 operably coupled to a drive motor 16 to produce an engine output.

Engine output speed control mechanism 18 comprises a foot pedal 20 coupled through a control linkage 22 to a servo control valve 24 which controls the output of a cylinder 26 coupled to the respective infinitely variable position swash plates 28 and 30 of pumps 12 and 14 respectively. Engine output speed control mechanism 18 is more thoroughly described in accompanying patent application Ser. No. 251,439 entitled "Pump Centering Control" filed concurrently with the present application, and assigned to the Assignee of the present invention. Reference may be had thereto for a more complete description of the foot pedal control linkage.

The control mechanism associated with the pump output includes the lost motion connection 32 between rear and front swash plates 28 and 30 of hydrostatic output pumps 12 and 14 respectively. The lost motion connection 32 includes a link 34 pinned at respective rear and front swash plates 28 and 30 as at pivotable pin connections 36 and 38. The pin 38 which pins the member 34 to the front swash plate 30 of the front pump 14 passes through and is carried in an elongated slot 40 in the member 34.

A dampener 42 is pinned between rear swash plate 28 and a forward anchor 45 rigidly mounted on the frame adjacent the rear of the front swash plate 30 as at pivotable pin connections 44 and 46 respectively. The dampener 42 is fully extended between the pin connections 44 and 46 when the swash plate 28 is in the neutral position. A cylinder end 48 of the dampener 42 is mounted adjacent the rear swash plate 28 at the pin connection 44 and a rod end 50 of the dampener 42 is pinned at connection 46 on the anchor 45. A compression spring 52 is mounted between the cylinder end 48 and the rod end 50 of the dampener 42. The dampener 42 is in a fully extended condition when the swash plate 28 is in the neutral position. Compression spring 52 provides a constant force on dampener 42 to maintain the dampener 42 in the extended position when no force is applied to the swash plate 28 through member 34. Cylinder 26 is pinned on the swash plate 30 at cylinder end **26*a* at pin connection 54 and rod end 26*b* of the cylinder 26 is pinned on the vehicle frame at point 56**.

Operation of the Preferred Embodiment

When the foot pedal 20 is engaged downwardly to urge the vehicle in a forward direction the pedal linkage 22 pivots bell crank 58 counterclockwise to urge link 60 outwardly and activate the servo control valve 24 to urge the cylinder end **26*a* of the cylinder 26 forward toward the pin connection 56 at the rod end 26*b* of the cylinder 26. When the cylinder end 26*a* of the cylinder 26 is urged forward the front swash plate 30 of the forward pump 14 is also pulled forward to provide the drive motor 16 with the output of the pump 14 to operate the vehicle solely from the output of the pump 14**.

Should the operator increase the downward travel of the foot pedal 14 and respectively increase the outward travel of the link 60 to further increase the travel of the cylinder 26, such increased travel would further rotate the front swash plate 30 until the pin connection 38 abutted the end of the slot 40 in the lost motion connection member 34. When the end of the slot 40 is reached, increased movement of the front swash plate 30 will initiate movement of the rear swash plate 28 of the rear pump 12 to provide output from both of the drive pumps 12 and 14 to the motor 16.

Should the operator then remove his foot from the pedal 20 the centering mechanism 62 described in more detail in the aforementioned U.S. patent application Ser. No. 251,439 entitled "Pump Centering Control" would return the foot pedal 20 to a neutral position and also return the servo control valve 24 and the cylinder 26 to a neutral position. The dampener 42 has been designed to provide controlled acceleration and deceleration rates. The spring 52 will assure that the rear swash plate 28 will always return to a centered or neutral position during deceleration.

As is readily apparent from a viewing of the drawing, it is clear that the slot 40 in the lost motion connection member 34 is considerably longer behind the pin connection 38 than it is to the front of the pin connection 38. Therefore, when the vehicle is operating in the reverse mode and the front swash plate 30 is extended rearwardly, the rear swash plate 28 remains in the neutral position because the vehicle is operating with only the output of the front pump 14 when it operates in the reverse direction.

Of course, with a modification of the lost motion connection member 34 and of the mounting arrangement for the dampener 42, it would be simple enough to provide a two speed function in both directions. However, in the present embodiment it was desirable to provide limited speed in reverse to prevent the operator from traveling too fast in reverse. The fact that the inventor chose to display and describe the preferred embodiment should not limit the scope of protection available.

The embodiments of the present invention in which an exclusive property or priviledge is claimed are defined as follows.

We claim:

1. An improved hydrostatic control system for controlling the output of a hydrostatic drive unit for a vehicle, the drive unit comprising:

a pair of output pumps axially aligned, each of the output pumps having an infinitely variable swash plate operatively connected thereto to control the output of the respective pumps;

a drive motor;

cooperative means between the drive motor and the output pumps to couple the output pumps to the drive motor without intervening valves or other flow control devices;

operative means to control the output of the drive motor; and the improvement comprising a lost motion connecting means provided between the swash plates of the aligned drive pumps, such lost motion connecting means including a single operator control device to sequentially control the output of one or both pumps.

2. An improved hydrostatic control system for controlling the output of a hydrostatic drive unit for a vehicle as claimed in claim 1 wherein the lost motion connection between the swash plates of the axially aligned output pumps includes a connecting member pivotally mounted on both pumps, the forward connecting member including an elongated slot which permits movement of one swash plate of the vehicle independently of the second swash plate of the vehicle.

3. An improved hydrostatic control system for controlling the output of a hydrostatic drive unit for a vehicle as claimed in claim 1 or 2 wherein a dampener is disposed between the rear swash plate and an anchor adjacent the front swash plate of the vehicle, the dampener fully extended when the swash plates are aligned in the neutral position and a compression spring disposed between the rod end and the cylinder end of the dampener to maintain the rear swash plate in the neutral position when the dampener is fully extended.

4. An improved hydrostatic control system for controlling the output of a hydrostatic drive unit for a vehicle as claimed in claim 1 wherein the operative means to control the output of the drive motor includes a pedal linkage arrangement cooperatively connected between a foot pedal of the vehicle and a servo control valve controlling the output of a cylinder which is operatively coupled to the forward swash plate of the pair of axially aligned drive pumps whereby activation of the servo control valve through the foot pedal activates the cylinder to urge the front swash plate forward, the lost motion connection permitting the second motor to engage when the front swash plate has been sufficiently extended in a forward or reverse direction.

5. An improved method for controlling the output of a hydrostatic drive unit, wherein the drive unit comprises:

a pair of output pumps axially aligned, each of the output pumps having an infinitely variable position swash plate operatively connected thereto to control the output of the respective pumps;

a drive motor;

cooperative means between the drive motor and the output pumps to couple the output pumps to the drive motor;

operative means including a pedal member to control the output of the drive motor; and the improved method comprises providing a lost motion connection between the swash plates of the axially aligned output pumps including providing a connecting member pivotally mounted on both pumps, the forward connecting member including an elongated slot which permits movement of one swash plate of the vehicle independently of the second swash plate of the vehicle.

6. An improved method for controlling the output of a hydrostatic drive unit for a front end loader as claimed in claim 5 wherein providing the cooperative connecting means includes providing a dampener disposed between the rear swash plate and an anchor adjacent the front swash plate of the vehicle, the dampener fully extended when the swash plates are aligned in the neutral position and a compression spring disposed between the rod end and the cylinder end of the dampener to maintain the rear swash plate in the neutral position when the dampener is fully extended.

7. An improved method for controlling the output of a hydrostatic drive unit for a front end loader as claimed in claim 5 wherein the operative means to control the output of the drive motor includes a pedal linkage arrangement cooperatively connected between a foot pedal of the vehicle and a servo control valve controlling the output of a cylinder which is operatively coupled to the forward swash plate of the pair of axially aligned drive pumps whereby activation of the servo control valve through the foot pedal activates the cylinder to urge the front swash plate forward, the lost motion connection permitting the second motor to engage when the front swash plate has been sufficiently extended in a forward or reverse direction.

8. An improved hydrostatic control system for controlling the output of a hydrostatic drive unit for a vehicle, the drive unit comprising:

a pair of hydrostatic output pumps axially aligned, each of the hydrostatic output pumps having an infinitely variable position swash plate mounted thereon;

a drive motor;

cooperative means between the drive motor and the output pumps to couple the output pumps to the drive motor;

operative means to control the output of the drive motor; and the improvement comprising a lost motion connecting means cooperatively connected between the swash plates of the aligned hydrostatic drive pumps, the lost motion connecting means including a lost motion connecting member pivotally mounted at each end to respective front and rear swash plates of the front and rear drive pumps, the lost motion connecting member having an elongated slot in which the connection between the front swash plate and the lost motion connecting member is disposed, said operative means including a servo control valve controlling the horizontal forward and reverse output of a cylinder rigidly coupled to the frame whereby selective control of the servo control valve controls the output of the cylinder operatively connected to the front swash plate of the pair of axially aligned drive pumps, and activation of the servo control valve causes the cylinder to rotate the front swash plate until it engages the forward edge portion of the slot provided on the lost motion connecting member whereupon further rotation of the front swash plate forces rotation of the rear swash plate to selectively couple the output of both drive pumps to the drive motor.

9. An improved hydrostatic control system for controlling the output of a hydrostatic drive unit for a vehicle as claimed in claim 8 wherein the cooperative connecting means between the aligned drive pumps includes a dampener having a rod end and a cylinder and mounted between the rear swash plate and an anchor mounted to the frame adjacent the front swash plate, the dampener being fully extended when the front and rear swash plates are disposed in a neutral position, the dampener being compressed when the rear swash plate is moved forwardly, and a compression spring mounted on the dampener between the rod end and the cylinder end of the dampener to return the rear swash plate to a neutral position when the operative means controlling the output of the drive motor is released.

10. An improved hydrostatic control system for controlling the output of a hydrostatic drive unit for a vehicle as claimed in claim 9 wherein the operative means to control the output of the drive motor includes a cooperative pedal linkage disposed between the servo control valve and an operator foot pedal for controlling the output of the drive motor.

11. An improved method for controlling the output of a hydrostatic drive unit for a vehicle, the drive unit comprising:

a pair of hydrostatic output pumps axially aligned, each of the hydrostatic output pumps having an infinitely variable position swash plate mounted thereon;

a drive motor;

cooperative means between the drive motor and the output pumps to couple the output pumps to the drive motor;

operative means to control the output of the drive motor; and the improvement comprising providing a lost motion connecting means cooperatively connected between the swash plates of the aligned hydrostatic drive pumps, the lost motion connecting means including a lost motion connecting member pivotally mounted at each end to respective front and rear swash plates of the front and rear drive pumps, providing the lost motion connecting means with an elongated slot wherein which the connection between the front swash plate and the lost motion connecting member is disposed, said operative means including a servo control valve controlling the horizontal forward and reverse output of a cylinder rigidly coupled to the frame, whereby selective control of the servo control valve controls the output of the cylinder operatively connected to the front swash plate of the pair of axially aligned drive pumps and activation of the servo control valve causes the cylinder to rotate the front swash plate until it engages the forward edge portion of the slot provided on the lost motion connecting member whereupon further rotation of the front swash plate forces rotation of the rear swash plate to selectively couple the output of both drive pumps to the drive motor.

12. An improved method for controlling the output of a hydrostatic drive unit for a vehicle as claimed in claim 11 wherein the cooperative connecting means between the aligned drive pumps is provided with a dampener having a rod end and a cylinder end mounted between the rear swash plate and an anchor mounted to the frame adjacent the front swash plate, the dampener being fully extended when the front and rear swash plates are disposed in a neutral position, the dampener being compressed when the rear swash plate is moved forwardly, and providing a compression spring mounted on the dampener between the rod end and the cylinder end of the dampener to return the rear swash plate to a neutral position when the operative means controlling the output of the drive motor is released.

13. An improved method for controlling the output of a hydrostatic drive unit for a vehicle as claimed in claim 12 wherein the operative means to control the output of the drive motor includes a cooperative pedal linkage disposed between the servo control valve and an operator foot pedal for controlling the output of the drive motor.

14. A hydrostatic drive comprising a hydraulic motor, two variable displacement pumps driven jointly by a common prime mover, conduit means connecting the outlets of both said pumps to the inlet of said motor without intervening valves or other flow control devices, an operator controlled infinitely variable operating means having two ranges, one range for varying the displacement of one of said pumps for operating said motor in one operating range, the other range for varying the displacement of both said pumps simultaneously for operating said motor in another operating range in the same direction, and said operator controlled infinitely variable operating means providing transfer from said one operating range to said other operating range without any separate action required by the operator.

15. A hydrostatic drive as in claim 14 wherein said one operating range is a lower speed range and said other operating range is a higher speed range.

16. A hydrostatic drive as in claim 15 wherein said operating means includes a foot pedal, and wherein said foot pedal moves farther in operating said operatine means through said one operating range than it does in operating said operating means through said other operating range.

17. A hydrostatic drive as in claim 14 wherein said operating means includes a third operating range in which said motor operates in the reverse direction from said other two operating ranges.

18. A hydrostatic drive as in claim 17 wherein said operating means includes a neutral position between said first operating range and said third operating range.

19. A hydrostatic drive as in claim 18 wherein said operating means includes means for selectively changing the displacement of said one pump from either said one or said other operating range back to neutral.

20. A hydrostatic drive as in claim 19 wherein said other pump is returned to neutral from said other operating range by a spring which continuously urges said other pump toward neutral.

21. A hydrostatic drive as in claim 17 wherein reverse drive is achieved by changing the displacement of said one pump in the opposite sense to said first operating range.

* * * * *